United States Patent [19]

Collins

[11] Patent Number: 4,669,338

[45] Date of Patent: Jun. 2, 1987

[54] RATCHETING BOX WRENCH

[76] Inventor: Bobby W. Collins, 4200 A Chateau Blvd., Kenner, La. 70062

[21] Appl. No.: 786,836

[22] Filed: Oct. 11, 1985

[51] Int. Cl.[4] ..... B25B 13/46

[52] U.S. Cl. ..... 81/57.39; 81/59.1

[58] Field of Search ..... 81/57.39, 59.1, 60–63.1

[56] References Cited

U.S. PATENT DOCUMENTS

| | | | |
|---|---|---|---|
| 418,337 | 12/1889 | Kors | 81/57.39 |
| 3,745,858 | 7/1973 | Biach | 81/57.39 |
| 4,141,262 | 2/1979 | Smith | 81/57.39 |
| 4,336,727 | 6/1982 | Junkers | 81/57.39 |
| 4,448,096 | 5/1984 | Collins | 81/57.39 |
| 4,513,645 | 4/1985 | Grabovac et al. | 81/57.39 |

FOREIGN PATENT DOCUMENTS

| | | | |
|---|---|---|---|
| 20446.6 | 12/1984 | Fed. Rep. of Germany . | |
| 07126.1 | 8/1985 | Fed. Rep. of Germany . | |
| 579132 | 11/1977 | U.S.S.R. | 81/57.39 |

*Primary Examiner*—Frederick R. Schmidt
*Assistant Examiner*—Maurina Rachuba
*Attorney, Agent, or Firm*—William David Kiesel; Robert C. Tucker

[57] ABSTRACT

A hydraulic torque wrench in which the base of the hydraulic cylinder attaches directly to the end of the torque wrench body, and the piston rod of the hydraulic cylinder attaches to the lever arm of the tool head whereby the lever arm is provided with a tracking arm guided within a recess of the torque wrench body.

6 Claims, 3 Drawing Figures

RATCHETING BOX WRENCH

BACKGROUND OF THE INVENTION

1. Field of the Invention

This invention relates in general to hydraulic torque wrenches and more particularly to ratcheting hydraulic torque wrenches.

2. Description of the Prior Art

The petro-chemical industry as well as industry in general relies on extensive use of pipes and large valves with bolted or studded flanges. Very large make-up torques of the magnitude of 2,500–5,000 ft-lbs rising to as high as 75,000 ft-lbs are needed to tighten down the nuts on these flanges. Additionally, break-out torque required may be four or five times the corresponding make-up torque needed for a given flange.

Consequently, heavy-duty wrenches, primarily hydraulic torque wrenches are needed. Wrenches in the prior art use a relatively complex system of gears, bushings, drive pawls, pins, etc., resulting in wrenches which are physically large, heavy and particularly cumbersome. This complexity gives rise to equipment mechanical failure.

Wrenches in the prior art have a poor mechanical advantage with the result that their torquing capacity is small in comparison to their bulk. The more advanced wrenches in the prior art use reaction plates which, because of their pinned wrench bodies, often require reaction rollers to increase the mechanical advantage of the wrench. While torque is increased by these designs for a given weight of the wrench, a great amount of space is still required around the workpiece for such wrenches to operate. Space restrictions exist between flange nuts and pipe walls or surfaces adjacent the flange. This problem of turning a bolt or nut in a confined space is no small problem and has been an unsolved need in industry.

Safety is a large factor not only from the obvious awkwardness of handling a large, heavy wrench (approximately 80 lbs) leading to the malalignment of a wrench on a bolt or dropping a wrench in an unbalanced position, but also for the improper tightening of a nut itself. In one example, improper tightening of compressor valves can result in a lethal explosion and fire when natural gas escapes after the nuts on studs are overtightened and fail from stress fatigue and tension.

Examples of the present state of the art can be seen in the following U.S. Patents:

| U.S. PAT. NO. | INVENTOR | ISSUED | TITLE |
|---|---|---|---|
| 3,745,858 | John L. Biach | 7/17/73 | TORQUING DEVICE |
| 4,027,561 | John K. Junkers | 6/07/77 | HYDRAULIC WRENCH |
| 4,385,533 | Bobby W. Collins | 5/31/83 | UNIVERSAL REACTION PLATE |
| 4,448,096 | Bobby W. Collins | 5/15/84 | FLUTTER LIFT FOR TORQUE WRENCH |

SUMMARY OF THE INVENTION

Therefore, one object of this invention is to provide a wrench with an increased mechanical advantage by effectively lengthening the lever arm by moving the pivot point to coincide with the center of the nut to be turned.

Another object of this invention is to reduce the number of parts needed to construct a torque wrench and at the same time reduce the weight.

Still another object of this invention is provide a wrench in which a variety of tool heads may be used.

Still a further object of this invention is to provide a tool head which is a box head and a ratcheting mechanism constructed so as to minimize tensional and compressional forces on the tool head.

Another object of this invention is to provide a hydraulic torque wrench capable of operating in confined spaces to the extent of fitting all fifty-seven API flange sizes.

Accordingly, a hydraulic torque wrench in which the base of the hydraulic cylinder attaches directly to the end of the torque wrench body, and the piston rod of the hydraulic cylinder attaches to the lever arm of the tool head whereby the lever arm is provided with a tracking arm guided within a recess of the torque wrench body.

PREFERRED EMBODIMENTS OF THE INVENTION

Figure 1:
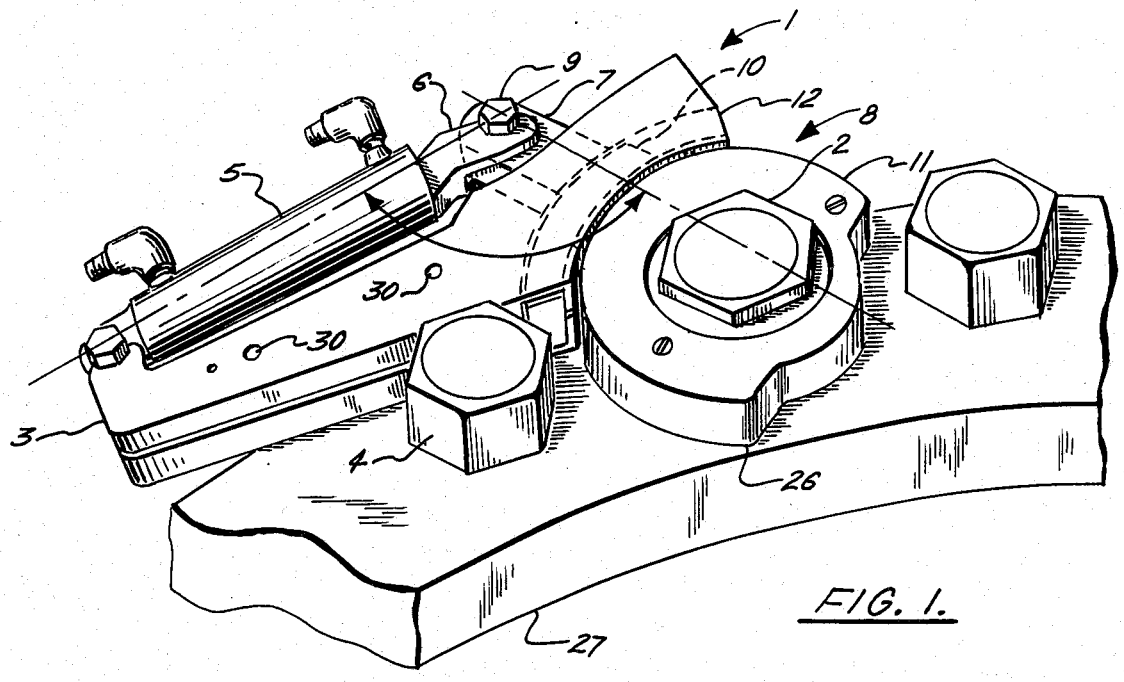
FIG. 1 is a perspective view of the ratcheting box wrench.

Referring now to FIG. 1 wherein the ratcheting box wrench referred to generally as 1 is positioned on a flange-nut 2 in a manner so that the wrench body 3 will contact an adjacent flange-nut 4. This will provide a base from which the ratcheting box wrench 1 will gain leverage. The hydraulic cylinder 5 is activated and its piston rod (not shown) will extend causing the front cylinder clevis 6 to make contact with the power connection arm 7 of the tool head assembly 8. The front cylinder clevis 6 is connected to the power connection arm 7 with a connection pin 9. As the power connection arm 7 is turned by the hydraulic cylinder 5, the tool head assembly 8 rotates. This rotation is further guided by a tracking arm 10 which is an integral part of the tool head assembly 8 located between the tool rim 11 and the power connection arm 7. The tracking arm 10 moves within a recessed channel 12 (shown by hidden lines on FIG. 1) within the wrench body 3. If this tracking arm is properly dimensioned, it will increase the wrench's ability to operate within a confined space since there will be no need to remove and reattach the wrench to the nut during the exercise of a normal ratchet cycle.

Figure 2:
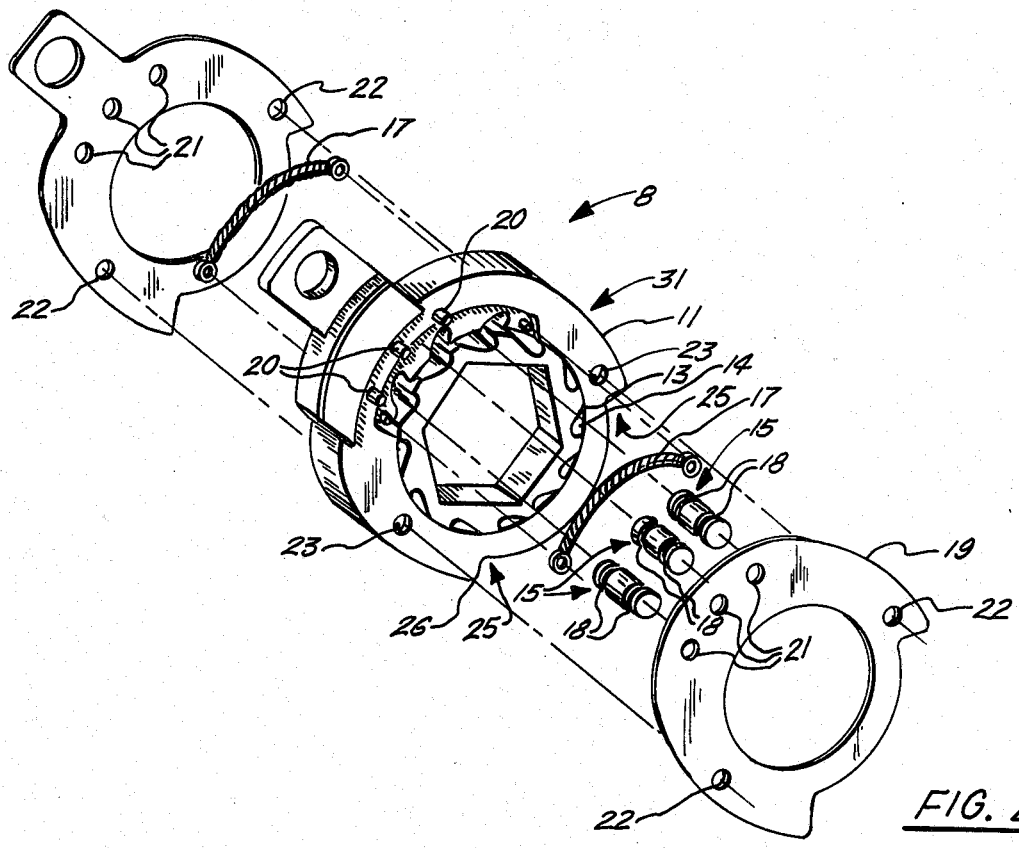
FIG. 2 is an exploded view of the tool head assembly.
Figure 3:
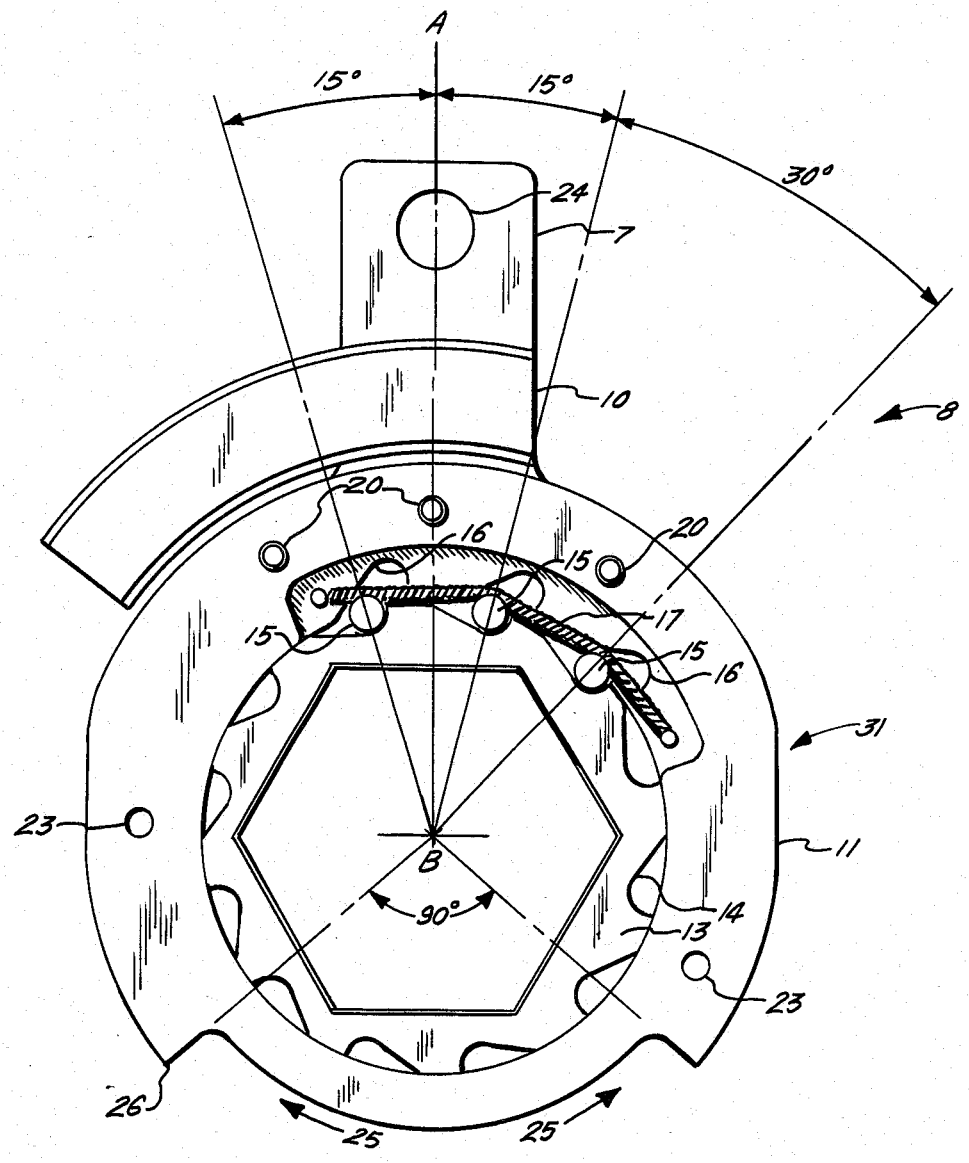
FIG. 3 is a plan view of the tool head assembly shown without its cover shield.

FIG. 2 shows an exploded view of the tool head assembly 8 which operates in the same plane as the hydraulic cylinder 5 with increased mechanical advantage over hydraulic socket wrenches. This feature can be exemplified by comparing a hand box wrench to a hand socket wrench. A box wrench produces a torquing action in the same plane as that of the turning nut. Contrast the power loss due to cross torque occurring when the socket wrench's lever arm torques in a plane a distance of the socket above the nut. A socket wrench has a force acting only parallel to the plane of the nut. The resultant vector of the socket wrench is not as efficient as an equal singular force acting in the same plane as the turning nut.

The tool head assembly 8 also provides the ratcheting aspect of this invention. The tool head assembly 8 consists of a tool head 31 to which the tracking arm 10 and the power connection arm 7 are an integral part. Within the tool head 31 is a retainer rim 11 as well as a ratchet gear 13 which contacts the workpiece, in this instance, flange-nut 2. The ratchet gear 13 has a series of arcuate channels 14 which are bevelled at one side and equally spaced around the circumference of the ratchet gear 13. These arcuate channels 14 provide a recess in which the roller drive pins 15 are positioned in and out of to provide the ratcheting motion. When the roller drive pins 15 are in the arcuate channels 14, they are in drive position to allow for the tool head assembly 8 to rotate the flange-nut 2. When the tool head assembly 8 is ratcheted back to its original position in a manner to allow it to make a second turn of the flange-nut 2, the roller drive pins 15 slip into a ratcheting slot 16 of the tool rim 11. The roller drive pins 15 are positioned and held in place for the drive portion of the cycle by springs 17 located on both sides of the roller drive pins 15. The roller drive pins 15 have circumferential spring alignment grooves 18 which keep these springs 17 properly positioned. The tool head assembly 8 is equipped with shields 19 which are positioned on both sides of the tool head 31 to protect the inner working mechanisms. These cover shields 19 are indexed into position by three positioning pegs 20 extending the retainer rim 11 into positioning apertures 21 located on the shields 19. The shields 19 are then held in place by screws (not shown) through screw-holes 22 located on the shields and aligning with threaded screw-holes 23 located on the retainer rim 11. When the screws are tightened, the shields 19 are held in place on the tool head 31.

The power connection arm 7 is provided with a connection pin aperture 24 through which the connection pin 9 is placed attaching the front cylinder clevis 6.

The retainer rim 11 is also provided with a flange-cut 25 which is located at a precise position on the retainer rim 11 (a 90 degree angle centered on a centerline drawn from the centerline of the connection arm through the center axis of the ratchet gear) so that when the ratcheting box wrench is operated, only a minimum of space is needed between the flange-nut 2 and any obstruction near the flange-nut (not shown). FIG. 1 shows the tool head assembly 8 and hydraulic cylinder 5 in a fully contracted position whereby the flange-cut end 26 would actually be touching an obstruction adjacent to the bolted flange 27. However, by observing the flange-cut 25 in FIG. 1 it can be seen that this feature will allow the flange-nut 2 to be turned requiring an absolute minimum of space between the flange-nut 2 and any obstruction (not shown). This required working space has been found to be three-tenths of an inch on working models.

In a preferred embodiment, the roller drive pins 15 have been found to exert the least pressure on the retainer rim 11 when only three roller drive pins 15 are used, and these roller drive pins 15 are located an equal distance 30 degrees apart on the circumference of the ratchet gear 13. Two of these roller drive pins 15 should each be located on opposite sides and at least 15 degrees from an imaginary centerline drawn from the centers of the connection pin aperture 24 and the ratchet gear 13. The third roller drive pin 15 should be located another 45 degrees around the circumference from the same centerline.

Additionally, a preferred embodiment of the wrench body 3 will be such that the wrench body consists of two halves which are joined together by allen inserts 30.

The ratchet gear 13 can be of design on the inside to allow for any number of sizes of flange-nuts, studs or bolts as well as shapes other than hexagonal.

Many other variations, modifications, and alternate embodiments may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations of the scope of this invention, as defined in the following claims.

What I claim is:

1. A torque wrench for operatively bolting or unbolting a workpiece comprising:

(a) a wrench body pivotally connected to one end of a reciprocating power means and having an arcuate shaped surface traversing an opposite end of said wrench body;

(b) a tool head assembly attached to an opposite end of said reciprocating power means comprising;

(i) a tool head body having an aperture dimensioned to the workpiece, (ii) a tracking arm attached to said tool head body and being shaped to be matingly slidable in said arcuate shaped surface, (iii) a tool head power connection means attached to and extending from said tracking arm for connecting the tool head to an opposite end of said reciprocating power means, (iv) a retainer rim having ratcheting slots, said retainer rim connectable at one side with said tracking arm; wherein said retainer rim further comprises a flange extending from the perimeter of said retainer rim wherein said flange has a 90 degree arc centered on the imaginary axis from the center of said tool head power connection means to the center of said retainer rim, (v) a plurality of roller drive pins attached to said tool head body and retractable within said ratcheting slots, (vi) one or more springs attached to said tool head body in a position for indexing said roller drive pins away from said ratcheting slots, (vii) a ratcheting gear operatively attached to said tool head body and postioned in said aperture for connecting the work piece, said ratcheting gear having a plurality of axially aligned and bevelled arcuate channels along the perimeter of said ratcheting gear wherein said plurality of axially aligned and bevelled arcuate channels receive said roller drive pins indexed away from said ratcheting slots.

2. A tool head according to claim 1 wherein said retainer rim further comprises:

(a) a compression side and a tension side, the position of said compression side and tension side are separated by an imaginary line axis drawn from the tool head power connection means to the center of the retainer rim;

(b) said retainer rim is provided with an imaginary arc, where two of said plurality of roller drive pins are located on the arc of the retainer rim at least 15 degrees but less than 30 degrees from said centerline axis.

3. A tool head according to claim 1 where said plurality of roller drive pins further comprises three roller drive pins.

4. A tool head according to claim 1 wherein said plurality of roller drive pins further comprises two roller drive pins.

5. A tool head according to claim 1 wherein said roller drive pins are spaced 30 degrees from each other.

6. A tool head according to claim 3 wherein said three roller drive pins are spaced 30 degrees from each other.

* * * * *